US005325805A

United States Patent [19]

Howson

[11] Patent Number: 5,325,805

[45] Date of Patent: Jul. 5, 1994

[54] METHOD FOR JOINING MODULES OF SHIPS

[75] Inventor: Robert E. Howson, New Orleans, La.

[73] Assignee: McDermott International, Inc., New Orleans, La.

[21] Appl. No.: 102,370

[22] Filed: Aug. 5, 1993

[51] Int. Cl.[5] ..... B63B 3/02

[52] U.S. Cl. ..... 114/77 A; 114/65 R

[58] Field of Search ..... 114/77 R, 77 A, 65 R, 114/79 W

[56] References Cited

U.S. PATENT DOCUMENTS 3,370,565 2/1968 Takezawa et al. ..... 114/77 R 3,765,359 10/1973 Takezawa et al. ..... 114/77 R

FOREIGN PATENT DOCUMENTS 1501657 2/1978 United Kingdom ..... 114/77 R

*Primary Examiner*—Jesus D. Sotelo

*Attorney, Agent, or Firm*—Robert J. Edwards; D. Neil LaHaye

[57] ABSTRACT

A method for joining modules of ships. Ship modules are fabricated in individual bays of fabrication buildings and then moved out of the buildings for attachment together to form the ship on water. This eliminates the need for large dry docks or launch areas. The modules are floated and positioned such that the edges to be joined are adjacent or abutting each other. A flexible strap may be positioned tightly against the joint exterior to prevent water entry or a floating structure may be positioned under the modules such that a circular cross section backing seal the joint to prevent water entry. The interior of the modules is dewatered and the modules are then welded together. The modules may be positioned adjacent each other above the waterline through the use of a barge and dry dock to eliminate the need for dewatering.

3 Claims, 1 Drawing Sheet

METHOD FOR JOINING MODULES OF SHIPS

BACKGROUND OF THE INVENTION

1. Field of the Invention

The present invention is generally related to shipbuilding and particularly to the joining of separate modules in building large ships.

2. General Background

For centuries a typical large wooden ship was constructed on a building ways under the supervision of a master shipwright. The wooden parts were fabricated piece by piece, and then fastened together on the building ways.

Shipbuilding techniques that proved effective in constructing wooden ships were often retained when wood was replaced, first by iron and later by steel. The shipyard's building ways was still the place where a highly skilled work force assembled the ship, piece by piece. The keel was laid first, followed by floors, frames, beams, decks, and hull plating. Initially metal structural members were joined together by riveting.

Since about 1940 the construction of both commercial and naval vessels has changed dramatically. These changes may, in part, be attributed to the development of new steels, the use of welded instead of riveted connections, the increased use of aluminum, the advent of computer-aided technology, construction orders for several identical ships, and, above all, the need to improve productivity. In conjunction with economic pressures, these changes have forced shipyards into developing a more efficient assembly process—one in which the flow of material, the building of subassemblies, and the final fabrication of the ship are merged to form a continuous process.

A modern shipyard is predominately an assembly facility. Subassemblies are joined together to form still larger modules, which in turn form major sections of the hull. These modules are then moved by large overhead cranes to various outfitting areas, where machinery foundations, pipes and valves, ventilation trunks, electrical cables, and various pieces of machinery are installed.

After as much of the outfitting as possible has been completed, the modules, typically weighing several hundred tons, are moved by gantry crane to the building dock or final assembly area. Here the modules are joined ("spliced") together to form a nearly complete ship. The long seams are then welded together mechanically.

Depending on the shipyard's arrangement and physical facilities, the actual launching may be performed by a variety of methods. A side or end launch may be performed from a building ways. The ship may also be launched from either a floating dry dock or a building dock, by flooding the dock until the ship floats. Building docks are very expensive and generally are used only for the final assembly of a ship's previously fabricated modules.

The key point is that in traditional shipbuilding, all large components are joined together while resting on or above dry land, with large, expensive dry or building docks needed to complete final assembly.

An efficient method for making the final, joining splice(s) in a floating position would eliminate the very expensive graying docks needed to construct mid-size ocean vessels.

Patents directed to modular shipbuilding or repair which applicant is aware of include the following.

U.S. Pat. Nos. 5,090,351 and 5,085,161 are directed to the construction of double-hulled tankers. A pontoon caisson provides an evacuated area for above and below-the-butt joint preparation and welding. The pontoon caisson is stationary and does not have its buoyancy adjusted. The hull modules are partially flooded to assist tilting of the modules by a derrick and movement of the modules over the caisson. Once over the caisson, the modules are flooded to submerge them hard aground on the caisson for joining.

U.S. Pat. No. 3,370,565 discloses a method and apparatus used to cut or join a structure floating on the water. A band is positioned over the area of the ship to be worked upon. The band is held in position by cables and sealed against the ship by pressurized fluid in grooves provided in the band. A working space in the center of the band that is positioned over the ship area to be worked upon is drained of water by making borings inside the hull. The working space is provided to vent gas produced during welding or cutting.

U.S. Pat. No. 4,155,322 discloses a floating caisson device to be placed below a vessel hull to provide a working space when joining floating hull sections. A flexible transition member on each end of the caisson that does not touch the welding zone on the hull is used to pull a packing member on each side of the hull into sealing engagement along the side length of the hull.

U.S. Pat. No. 3,611,968 discloses a watertight floating box with at least one sidewall being movable to accommodate different width vessels. Packings are pulled into contact with the vessel on either side of the welding area. Compressed air is introduced into the packings to establish a seal with the vessel.

U.S. Pat. No. 3,585,954 discloses a watertight floating caisson box having a movable side member to accommodate different width vessels. Watertight packings contact the vessel modules on either side of the welding area. This provides a dry work area once water has been removed from the area between the packings.

U.S. Pat. No. 3,407,771 discloses the use of holding plates attached to the exterior of shell plates on separate hull parts. The two hull parts are floated together such that the holding plates abut in a watertight engagement. Water in the adjoining hull parts is removed and the hull parts are then welded together.

U.S. Pat. No. 4,686,919 discloses a method for constructing large marine structures. The blocks of the marine structure are constructed in a deck and towed to an adjacent pond. Gates enclosing the pond are closed and the blocks are tack welded together. Water is drained from the pond to ground the tack welded blocks and the blocks are then fully welded together.

SUMMARY OF THE INVENTION

The present invention addresses the need for a method and apparatus for building large vessels. Modules or blocks of the vessel are fabricated in individual bays of fabrication buildings and then moved out of the buildings for attachment together to form the vessel on water. In one method, a flexible backing is forced around the exterior of the adjacent portions of two modules to allow a one-sided weld to be made from the inside of the modules after they have been dewatered. In another method, a dry dock and barge are used to support and position two modules above the water level while the modules are welded together. In another method, adjacent modules have their abutting edges sealed from water entry by a flexible backing that is held in place by hydrostatic pressure on the outside of the modules.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

In the present invention, large vessels are fabricated as modules or blocks in individual bays of fabrication buildings and then moved out to be joined together on water. The modules are preferably provided with bulkheads that prevent complete flooding of the modules and thus allow them to be floated into position when necessary.

Figure 1:
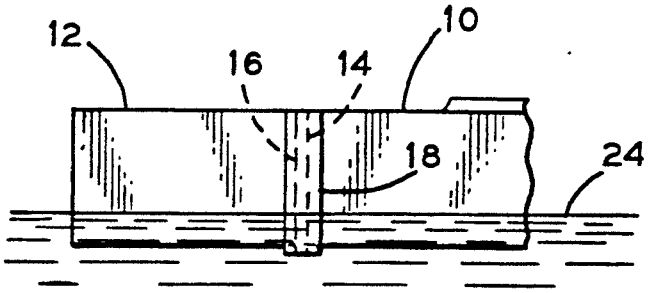
FIG. 1 is a side view that illustrates the use of a flexible backing at the joint of two modules.

In the method of FIG. 1, modules 10 and 12 are floated and positioned adjacent each other such that edges 14 and 16 to be joined are adjacent or abutting each other. A flat flexible ceramic band 18 is tightly positioned around the exterior of the joint formed by the adjacent edges such that water is prevented from entering the joint from the exterior. The interior of modules 10 and 12 is dewatered at the area of abutting edges 14 and 16. Modules 10 and 12 are then joined at the adjacent edges by welding on the interior of the modules. The process is repeated until all modules that make up the ship have been joined together. Ceramic strip 18 is preferably flat against modules 10 and 12 and over the joint therebetween. This prevents any deformation from occurring on the exterior of the joint during welding operations and thereby reduces post welding cleanup work on the exterior of the vessel.

Figure 2:
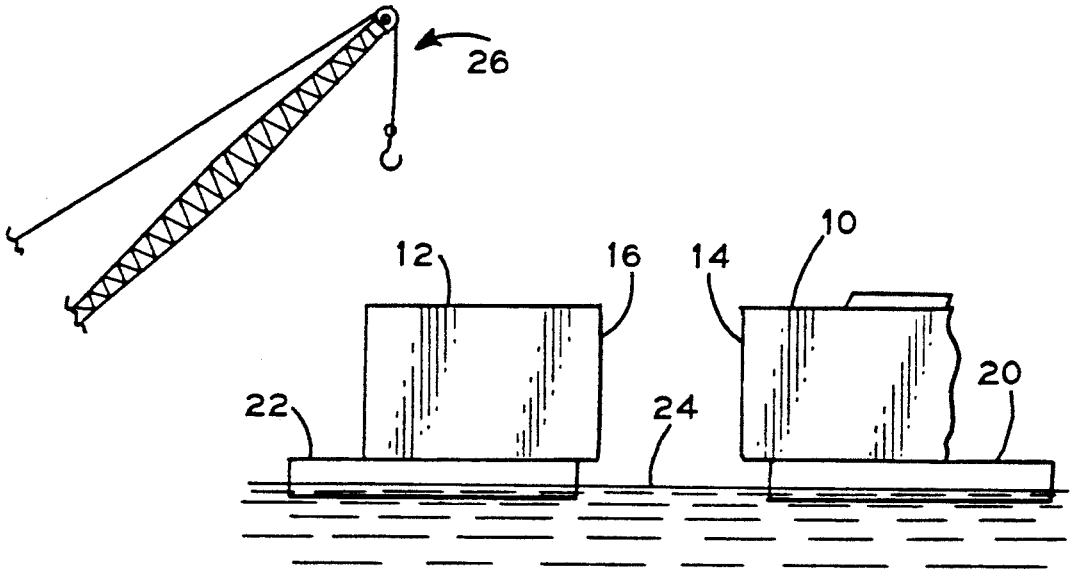
FIG. 2 is a side view that illustrates the use of a dry dock and barge for joining two modules above the water.

In the method of FIG. 2, module 10 is loaded onto a floating structure such as barge 20 such that edge 14 (the end to be joined to another module) extends beyond one end of barge 20. Module 12 is loaded onto a second barge or dry dock 22 such that edge 16 (the end to be joined to module 10) extends beyond one end over the water as indicated by waterline 24. Loading out of modules 10 and 12 may be accomplished by the use of crane 26. Barge 20 is positioned such that edges 14 and 16 to be joined are adjacent each other. The height of barge 20 or dry dock 22, or both, are then adjusted by ballasting or deballasting or by the use of crane 26 to vertically align modules 10 and 12. Modules 10 and 12 are then welded together. Joined modules 10 and 12 are then moved onto barge 20 or a combination of barges to provide the necessary flotation. Another module is loaded out onto dry dock 22 and the joining process is repeated until the entire ship has been formed. The barge or barges supporting the ship are then ballasted to allow the ship to be floated away.

Figure 3:
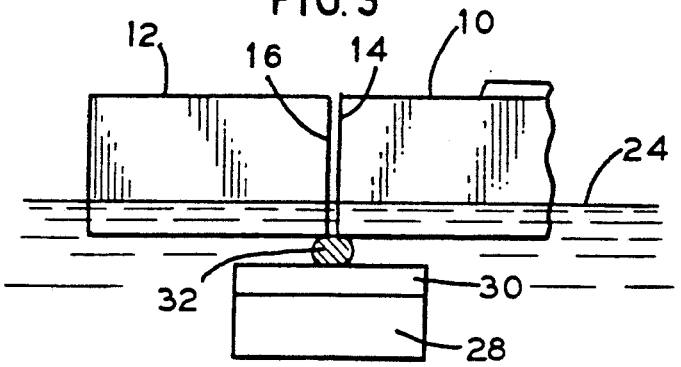
FIG. 3 is a side sectional view that illustrates the use of a flexible material and an expandable backing held in place by hydrostatic pressure.

In the method of FIG. 3, modules 10 and 12 are floated and positioned such that edges 14 and 16 to be joined are adjacent each other. A floating structure 28, such as a barge that has a flat top covered with a flexible material 30 and that has an expandable or ceramic backing 32 sized to cover the exterior of the joint formed by edges 14 and 16, is ballasted and moved under modules 10 and 12 such that backing 32 is aligned with the joint between edges 14 and 16. Structure 28 is then deballasted a sufficient amount to bring backing 32 into sealing contact with the joint formed between edges 14 and 16. The interior of modules 10 and 12 at the joint area is dewatered. At this point, hydrostatic pressure on flexible material 30 and backing 32 help serve to hold backing 32 in place. If an inflatable backing is used, then it is inflated to help create a seal and hold it in place before the interior of modules 10 and 12 is dewatered. Modules 10 and 12 are then joined by welding edges 14 and 16 together. Structure 28 is ballasted to lower it from joined modules 10 and 12 and the process is repeated until all the modules of the ship have been joined together.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A method for joining modules of ships, comprising:

a. floating and positioning the modules adjacent each other such that the edges to be joined are adjacent such other;

b. tightly positioning a flat flexible band in flat contact against the exterior of the modules over the joint formed by the adjacent edges of the modules such that water is eliminated between the band and the modules and is prevented from entering the joint from the exterior;

c. dewatering the interior of the adjacent modules at the abutting edges; and d. joining the adjacent modules at the adjacent edges by welding on the interior of the modules.

2. The method of claim 1, wherein the flat flexible band is formed from a ceramic material.

3. A method for joining modules of ships, comprising:

a. floating and positioning the modules adjacent each other such that the edges to be joined are adjacent each other;

b. positioning a floating structure having a top covered with a flexible material and a circular cross section backing under the modules such that the backing is aligned with and under the joint formed by the adjacent edges of the modules;

c. deballasting the floating structure to bring the circular cross section backing into sealing contact with the joint formed by the adjacent edges of the modules;

d. dewatering the interior of the adjacent modules at the abutting edges; and e. joining the adjacent modules at the adjacent edges by welding on the interior of the modules.

* * * * *